US006919156B2

(12) United States Patent
Kameyama et al.

(10) Patent No.: US 6,919,156 B2
(45) Date of Patent: Jul. 19, 2005

(54) TONER

(75) Inventors: Koji Kameyama, Wakayama (JP); Masahito Yamazaki, Wakayama (JP); Koji Akiyama, Wakayama (JP); Hiroyuki Kawaji, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/669,559

(22) Filed: Sep. 25, 2003

(65) Prior Publication Data

US 2004/0058263 A1 Mar. 25, 2004

(30) Foreign Application Priority Data

Sep. 25, 2002 (JP) ..... 2002-279479

(51) Int. Cl.[7] ..... G03G 9/087

(52) U.S. Cl. ..... 430/108.7; 430/109.4; 430/111.4; 430/124

(58) Field of Search ..... 430/108.7, 109.3, 430/109.4, 111.4, 124

(56) References Cited

U.S. PATENT DOCUMENTS 6,156,471 A * 12/2000 Kobori et al. ..... 430/108.6

6,248,495 B1 * 6/2001 Inokuchi et al. ..... 430/108.7

OTHER PUBLICATIONS

Diamond, Arthur S., ed., *Handbook of Imaging Materials*, Marcel Dekker, Inc., NY (1991), pp. 162–163.*

* cited by examiner

*Primary Examiner*—Janis L. Dote

(74) *Attorney, Agent, or Firm*—Oblon, Spivak, McClelland, Maier & Neustadt, P.C.

(57) ABSTRACT

A toner comprising a resin binder, a colorant, and fine inorganic particles having a BET specific surface area of 30 $m^2/g$ or less, wherein the fine inorganic particles are added as an external additive, wherein the toner has a storage modulus at 100° C. using a 25 mm parallel plate of $7\times10^4$ Pa or less, a storage modulus at 60° C. using a 7.9 mm parallel plate of from $3\times10^8$ to $1\times10^9$ Pa, and a storage modulus at 70° C. using a 7.9 mm parallel plate of from $7\times10^6$ to $3\times10^8$ Pa; and a two-component developer comprising the toner. The toner can be used for the development of a latent image formed in electrophotography, electrostatic recording method, electrostatic printing method or the like.

14 Claims, No Drawings

TONER

FIELD OF THE INVENTION

The present invention relates to a toner comprising fine inorganic particles used for the development of a latent image formed in electrophotography, electrostatic recording method, electrostatic printing method or the like, and a two-component developer comprising the toner.

BACKGROUND OF THE INVENTION

A non-contact fixing method, such as oven fixing or flash fixing, in which a toner is fixed by applying heat or light energy to a toner in a non-contacting state, has a feature that there is no offset phenomenon or deterioration of resolution which is problematic in a contact fixing method. Further, in a non-contact fixing method, since an unfixed image is not pressed, which is the case using a heat-roller fixing method, an even higher-quality image can be obtained.

However, in the non-contact fixing method, it is necessary to melt the toner instantly; thus improving the fixing ability is a serious problem to be solved especially in high-speed fixing devices. Therefore, toners for non-contact fixing using a specific resin binder are disclosed in Japanese Patent Laid-Open Nos. Hei 8-87130, Hei 5-107805, and the like. However, even though the fixing ability is improved, the durability is impaired, thereby resulting in lowering of the image density. Therefore, further improvements are desired.

SUMMARY OF THE INVENTION

The present invention relates to a toner comprising a resin binder, a colorant, and fine inorganic particles having a BET specific surface area of 30 $m^2/g$ or less, wherein the fine inorganic particles are added as an external additive, wherein the toner has a storage modulus at 100° C. using a 25 mm parallel plate of $7\times10^4$ Pa or less, a storage modulus at 60° C. using a 7.9 mm parallel plate of from $3\times10^8$ to $1\times10^9$ Pa, and a storage modulus at 70° C. using a 7.9 mm parallel plate of from $7\times10^6$ to $3\times10^8$ Pa.

The present invention also relates to a two-component developer comprising the toner as defined in the above and a carrier.

DETAILED DESCRIPTION OF THE INVENTION

All publications cited herein are hereby incorporated by reference.

The present invention provides a toner which has excellent durability, thereby continuously giving high-quality fixed images even in a non-contact fixing method; and a two-component developer comprising the toner.

The present inventors have found from electrophotographs of a conventional toner for non-contact fixing after the evaluation for the durability that the reason why the durability is decreased is that fine inorganic particles added as a fluidity improver are embedded in the toner which is designed to be easily softened for improving the fixing ability. Therefore, the present inventors have been studied resin binders and external additives. As a result, a newly generated problem of white spots can also be solved.

The toner of the present invention comprises externally added fine inorganic particles having a BET specific surface area of 30 $m^2/g$ or less, preferably from 5 to 30 $m^2/g$, more preferably from 10 to 20 $m^2/g$ (hereinafter referred to as "ultra large-particle size fine inorganic particles"), which are notably smaller than the conventional fine inorganic particles having a BET specific surface area of from 40 to 200 $m^2/g$, from the viewpoint of improvement in durability. Incidentally, the particle size of the particles having a BET specific surface area of 30 $m^2/g$ cannot be absolutely determined because the BET specific surface area depends on the surface conditions of the inorganic particles. The particle size of the inorganic particles is equivalent to about 100 nm or so. In addition, in the present invention, the BET specific surface area is preferably determined by the nitrogen adsorption method.

Commercially available ultra large-particle size fine inorganic particles having the above-defined BET specific surface area include "AEROSIL YP-NX 10" (commercially available from Nippon AEROSIL, BET specific surface area: 10 $m^2/g$), "AEROSIL YP-NX 30" (commercially available from Nippon AEROSIL, BET specific surface area: 30 $m^2/g$), and the like. As the method for adjusting the particle size, for instance, the fine inorganic particles having the desired BET specific surface area can also be obtained by disintegrating fine inorganic particles with a HENSCHEL® mixer, thereafter removing coarse grains with a cyclone by means of a jet stream transport, and collecting the fine particles using a dust-collecting filter or the like.

The ultra large-particle size fine inorganic particles include silica, titania, alumina, zirconia, tin oxide, zinc oxide and the like. Among them, silica and titania are preferable, from the viewpoint of more effectively obtaining the effects in the durability caused by preventing silica embedment, and silica is more preferable from the viewpoint of charging stability.

Further, it is preferable that the ultra large-particle size fine inorganic particles are subjected to hydrophobic treatment, from the viewpoint of stability in environmental resistance due to moisture adsorption. The method of hydrophobic treatment is not particularly limited. The agent for hydrophobic treatment includes hexamethyldisilazane, n-butyltrimethoxysilane, dimethyldichlorosilane, dimethylsiloxane, silicone oil, methyltriethoxysilane, and the like. Among them, hexamethyldisilazane, n-butyltrimethoxysilane and dimethyldichlorosilane are preferable. It is preferable that the treated amount of the agent for hydrophobic treatment is from 1 to 7 $mg/m^2$ per surface area of the fine inorganic particles.

The content of the ultra large-particle size fine inorganic particles is preferably from 0.01 to 1.5 parts by weight, more preferably from 0.05 to 0.5 parts by weight, based on 100 parts by weight of the toner before the treatment with the external additive (untreated toner).

Incidentally, other known fine inorganic particles having a BET specific surface area exceeding 30 $m^2/g$ or fine organic particles may be used together as an external additive for the toner in an amount within the range which would not deteriorate the effect of the ultra large-particle size fine inorganic particles in the present invention. In particular, by using small-particle size silica having a BET specific surface area of preferably 50 $m^2/g$ or more, more preferably from 80 to 200 $m^2/g$, together with the ultra large-particle size fine inorganic particles, the flowability of the toner become excellent, so that the effects of the present invention are more remarkably exhibited.

The content of the small-particle size silica is preferably from 5 to 600 parts by weight, more preferably from 10 to 500 parts by weight, even more preferably from 50 to 400 parts by weight, based on 100 parts by weight of the ultra large-particle size fine inorganic particles.

Also, the content of the fine organic particles is preferably from 5 to 600 parts by weight, more preferably from 10 to 500 parts by weight, even more preferably from 50 to 400 parts by weight, based on 100 parts by weight of the ultra large-particle size fine inorganic particles.

The ultra large-particle size fine inorganic particles are prevented from being embedded in the toner, thereby making it highly effective in improving durability. However, the external addition of the ultra large-particle size fine inorganic particles is likely to cause deterioration of the image quality due to developing failure, as well as charging failure, contamination in the device and damage on the photoconductor due to the free particles. Particularly, as a result of further studies, the present inventors have found that there arises a problem peculiar to the non-contact fixing method, which is not found in a contact fixing method, and that improvement in the image quality during fixing is an additional problem yet to be solved. Therefore, the characteristics of the toner surface have been further studied. As a result, the present inventors have found that when the storage modulus of a toner under specified temperature conditions, specifically at 60°, 70° and 100° C., are within a specified range, all of the above-described problems are solved, so that the toner has excellent durability and the image quality is drastically improved.

In the present invention, the storage modulus at 60° C. ($G'_{60}$) and the storage modulus at 70° C. ($G'_{70}$) are a supposed hardness of the toner surface in a developer device. When the storage modulus is too small, even the ultra large-particle size fine inorganic particles may be embedded in a toner, thereby causing the deterioration of the image quality due to transfer failure, lowering of the triboelectric charges and the like. Also, when the storage modulus is too large, the ultra large-particle size fine inorganic particles are easily freed, thereby causing contamination in the device and a decrease in image density due to charging failure.

From these viewpoints, $G'_{60}$ is from $3\times10^8$ to $1\times10^9$ Pa, preferably from $4\times10^8$ to $1\times10^9$ Pa, more preferably from $5\times10^8$ to $9\times10^8$ Pa, and $G'_{70}$ is from $7\times10^6$ to $3\times10^8$ Pa, preferably from $8\times10^6$ to $2\times10^8$ Pa, more preferably from $9\times10^6$ to $1\times10^8$ Pa. Although not wanting to be limited by theory, the reason why the storage modulus at 60° C. and the storage modulus at 70° C. are considered important properties in the present invention is presumably due to the fact that the durability is influenced greatly by the toner strength near the glass transition point at which the toner is being transformed from a glassy state. It is preferable that a high modulus is still maintained at both temperatures, and $G'_{60}/G'_{70}$ is preferably from 2 to 30, more preferably from 4 to 20, even more preferably from 5 to 15. The storage modulus G' is measured according to the method for measuring storage modulus described below.

On the other hand, defining the storage modulus at 100° C. ($G'_{100}$) is highly effective for preventing deterioration of the image quality due to the ultra large-particle size fine inorganic particles during toner fixing. In contact fixing in which fixing is carried out by pressing a toner with a heat roller or the like, an external additive is pressed into the internal part of the resin, so that there is little external additive on the toner. On the other hand, in a non-contact fixing in which a toner is instantly fixed by heat or light, an external additive is likely to remain on the surface of a fixed image. Especially when ultra large-particle size fine inorganic particles are used, aggregates of the particles appear as white spots on the fixed images, thereby drastically deteriorating the image quality. However, when $G'_{100}$ is $7\times10^4$ Pa or less, preferably $6\times10^4$ Pa or less, and more preferably $5\times10^4$ Pa or less, high quality images can be obtained. In addition, in order to prevent the spread of the melted toner, $G'_{100}$ is preferably $6\times10^3$ Pa or more, more preferably $7\times10^3$ Pa or more. In other words, the $G'_{100}$ range is preferably from $7\times10^4$ to $6\times10^3$ Pa, more preferably from $6\times10^4$ to $6\times10^3$ Pa, even more preferably from $5\times10^4$ to $7\times10^3$ Pa, from the viewpoint of preventing white spots and the spread of the toner. Although the reason why the above-described effects can be obtained by controlling the $G'_{100}$ has not been clear, it is presumed, though not wanting to be limited by theory, that when $G'_{100}$ is within the above-described range, the toner surface is easily softened upon fixing so that fine inorganic particles are easily inserted into a toner. Incidentally, it is considered that the coefficient of viscosity may be correlated from the viewpoint of inserting the fine inorganic particles into a toner. However, although the reason is not clear, the elastic modulus is well correlated. In addition, a value for $G'_{100}$ is determined by using a 25 mm parallel plate, and values for $G'_{60}$ and $G'_{70}$ are determined by using a 7.9 mm parallel plate, for the reason that when a 7.9 mm parallel plate is used for determining a value for $G'_{100}$, the determination values are varied and unreliable.

The storage modulus of the toner can be controlled by the average molecular weight and the kind of raw material monomers of the resin binder and the content of low-molecular components in the toner.

The resin binder in the present invention includes polyesters, styrene-acrylic resins, hybrid resins, epoxy resins, polycarbonates, polyurethanes, and the like, without being particularly limited thereto. Among them, from the viewpoints of the dispersibility of the colorant and the transferability, polyester and hybrid resin are preferable, and polyester is more preferable. The content of the polyester is preferably from 50 to 100% by weight, more preferably from 80 to 100% by weight, even more preferably 100% by weight, of the resin binder.

Incidentally, the term "hybrid resin" as referred to herein is a resin in which a condensation polymerization resin component, such as a polyester, and an addition polymerization resin component, such as a vinyl resin, are partially chemically bonded to each other. The hybrid resin may be obtained by using two or more resins as raw materials, or it may be obtained by using one resin and raw material monomers of another resin. Further, the hybrid resin may be obtained from a mixture of raw material monomers of two or more resins. In order to efficiently obtain a hybrid resin, those obtained from a mixture of raw material monomers of two or more resins are preferable.

The polyester is prepared by polycondensation of raw material monomers comprising an alcohol component comprising dihydric or higher polyhydric alcohols and a carboxylic acid component comprising dicarboxylic or higher polycarboxylic acid compounds.

The dihydric alcohol includes alkylene(2 to 3 carbon atoms) oxide(average number of mol: 1 to 10) adduct of bisphenol A such as polyoxypropylene(2.2)-2,2-bis(4-hydroxyphenyl)propane and polyoxyethylene(2.0)-2,2-bis(4-hydroxyphenyl)propane; ethylene glycol, propylene glycol, 1,6-hexanediol, bisphenol A, hydrogenated bisphenol A, and the like.

The trihydric or higher polyhydric alcohol includes sorbitol, 1,4-sorbitan, pentaerythritol, glycerol, trimethylolpropane, and the like.

In addition, the dicarboxylic acid compound includes dicarboxylic acids such as phthalic acid, isophthalic acid, terephthalic acid, fumaric acid and maleic acid; a substituted succinic acid of which substituent is an alkyl group having 1 to 20 carbon atoms or an alkenyl group having 2 to 20 carbon atoms; acid anhydrides thereof; alkyl(1 to 12 carbon atoms) esters thereof; and the like.

The tricarboxylic or higher polycarboxylic acid compound includes 1,2,4-benzenetricarboxylic acid (trimellitic acid), acid anhydrides thereof, alkyl(1 to 12 carbon atoms) esters thereof, and the like.

The polyester can be prepared by, for instance, polycondensation of an alcoholic component and a carboxylic acid component at a temperature of 180° to 250° C. in an inert gas atmosphere under a reduced pressure in the presence of an esterification catalyst as desired.

Incidentally, in the present invention, a toner having the desired storage modulus can be obtained by controlling and taking into consideration the kinds of raw material monomers of the resin, the softening point and the glass transition point of the resin, blending techniques, and the like based on the technical common knowledge of one of ordinary skill in the art. For instance, a preferable polyester is prepared by polycondensation as raw material monomers an alcohol component comprising as a main component an aromatic alcohol such as an alkylene oxide adduct in an amount of preferably 50% by mol or more, more preferably substantially 100% by mol, with a carboxylic acid component comprising an aromatic carboxylic acid compound such as phthalic acid, isophthalic acid, terephthalic acid or trimellitic acid in an amount of 20% by mol or more, preferably from 30 to 100% by mol.

The polyester has a softening point of preferably from 95° to 135° C., more preferably from 100° to 115° C., from the viewpoints of the fixing ability and the durability, and a glass transition point of preferably from 50° to 85° C. Also, it is preferable that the polyester has an acid value of from 0.1 to 30 mg KOH/g, and a hydroxyl value of from 5 to 50 mg KOH/g. Incidentally, a toner having the desired storage modulus can be also obtained by using as a polyester a low-softening point resin together with a high-softening point resin. In this case, it is preferable that a resin having a softening point of from 95° to 110° C. (low-softening point resin), and a resin having a softening point exceeding 110° C. and 160° C. or lower (high-softening point resin) are mixed in a ratio of low-softening point resin/high-softening point resin of from 10/90 to 90/10, preferably from 40/60 to 80/20.

As the colorant, all of the dyes, pigments and the like which are used as colorants for toners can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants can be used alone or in admixture of two or more kinds. In the present invention, the toner may be any of black toner, color toner and full-color toner. The content of the colorant is preferably from 1 to 40 parts by weight, more preferably from 3 to 10 parts by weight, based on 100 parts by weight of the resin binder.

The toner of the present invention may appropriately contain an additive such as a charge control agent, a releasing agent, a fluidity improver, an electric conductivity modifier, an extender, a reinforcing filler such as a fibrous substance, an antioxidant, an anti-aging agent, and a cleanability improver.

The charge control agent includes positively chargeable charge control agents such as Nigrosine dyes, triphenylmethane-based dyes containing a tertiary amine as a side chain, quaternary ammonium salt compounds, polyamine resins and imidazole derivatives, and negatively chargeable charge control agents such as metal-containing azo dyes, copper phthalocyanine dyes, metal complexes of alkyl derivatives of salicylic acid and boron complexes of benzilic acid. The toner of the present invention may be either positively chargeable or negatively chargeable. Also, a positively chargeable charge control agent and a negatively chargeable charge control agent may be used together.

The releasing agent includes waxes such as natural ester waxes such as carnauba wax and rice wax; synthetic waxes such as polypropylene wax, polyethylene wax and Fischer-Tropsch wax; coal waxes such as montan wax, alcohol waxes. These waxes may be contained alone or in admixture of two or more kinds.

The toner in the present invention is preferably prepared by a surface treatment step comprising mixing an untreated toner with an external additive using a HENSCHEL® mixer or the like. The untreated toner can be prepared by any of conventionally known methods such as the kneading and pulverization method, emulsion and phase inversion method and polymerization method, and preferably prepared by the kneading and pulverization method from the viewpoint of easy preparation. Incidentally, in a case of a pulverized toner prepared by the kneading and pulverization method, the toner can be prepared by homogeneously mixing a resin binder, a colorant, and the like in a mixer such as a HENSCHEL® mixer, thereafter melt-kneading with a closed kneader or a single-screw or twin-screw extruder, cooling, pulverizing and classifying the product. In the emulsion and phase inversion method, the toner can be prepared by dissolving or dispersing a resin binder, a colorant, and the like in an organic solvent, thereafter emulsifying the resulting mixture by adding water thereto, and the like, and then separating and classifying the product. The volume-average particle size of the toner is preferably from 3 to 15 $\mu$m.

In the toner of the present invention, the content of the substance having a number-average molecular weight of 500 or less, such as the substance originated from the resin binder component, and various additives such as stearic acid, preferably the substance originated from the resin binder component, is preferably from 1 to 4%, more preferably from 2 to 3.5% of the toner. The substance having a number-average molecular weight of 500 or less is effective for controlling the properties of a toner as shown by the storage modulus of the toner and the adhesive property of the toner surface, so that the adhesive strength of the ultra large-particle size fine inorganic particles is controlled, whereby the effects of the present invention can be enhanced. Incidentally, the substance having a number-average molecular weight of 500 or less which can be contained in the toner includes, for instance, raw material monomers, oligomeric components thereof and the like.

Since the toner of the present invention is excellent in the thermal softening property and also in durability, the toner is preferably used as a toner for the non-contact fixing method in which the fixing is carried out by applying light or heat energy to a toner in a non-contacting state. The non-contact fixing method includes an oven fixing method in which a toner on a sheet is melted and fixed by infrared radiation heat or convection heat from a plane heater or a ribbon heater, a flash fixing method in which a toner on a sheet is fixed by flash from a xenon lamp or the like, and the like. It is preferable that the toner of the present invention is used as a toner for oven fixing. It is more preferable that the toner is used as a toner for radiant fusing in which energy is concentrated on a toner having a high radiation ratio, thereby increasing the fixing efficiency. Therefore, since the toner of the present invention can give images of excellent quality even in a non-contact fixing method, the toner can be also suitably used in a method for forming fixed images comprising a non-contact fixing step.

Further, since the toner of the present invention can maintain long-term durability and provide excellent image quality, the toner can be also suitably used in a method for forming fixed images comprising employing a high-speed apparatus comprising a photoconductor having a linear speed of 400 mm/sec or more, more preferably from 450 to 2400 mm/sec, especially an organic photoconductor, which particularly requires durability such as the prevention of filming on the photoconductor.

In addition, the toner of the present invention can be used alone as a developer, in a case where the fine magnetic material powder is contained. Alternatively, in a case where the fine magnetic material powder is not contained, the toner can be used as a nonmagnetic monocomponent developer, or the toner can be mixed with a carrier and used as a two-component developer. Particularly, the toner of the present invention can be favorably used as a toner for two-component development which requires durability against toner adhesion to a carrier, or the like.

In a two-component developer comprising the toner of the present invention and a carrier, the core material for a carrier can be made from any of those known materials without any particular limitation. The core material includes, for instance, ferromagnetic metals such as iron, cobalt and nickel; alloys and compounds such as magnetite, hematite, ferrite, copper-zinc-magnesium-based ferrite and manganese-based ferrite; glass beads; and the like. Among them, magnetite, ferrite, copper-zinc-magnesium-based ferrite and manganese-based ferrite are preferable.

The surface of the carrier is one in which the surface may be coated with a resin from the viewpoint of the prevention of toner spent because the toner of the present invention is especially easily thermally melted. The resin for coating the surface of a carrier varies depending upon the materials for the toner. The resin includes, for instance, polytetrafluoroethylene, a monochlorotrifluoroethylene polymer, poly(vinylidene fluoride), a silicone resin such as dimethylsilicone, a polyester resin, a styrenic resin, an acrylic resin, polyamide, polyvinyl butyral, an aminoacrylate resin, and the like. These resins can be used alone or in admixture of two or more kinds.

The method for coating the core material with the resin is not particularly limited. The method includes a method comprising dissolving or suspending a coating material such as a resin in a solvent, and applying the resulting solution to allow the resin to adhere to a carrier, a method comprising simply mixing a coating material such as the resin as a powder, and the like.

The two-component developer of the present invention can be prepared by mixing the toner of the present invention and a carrier with a known mixer such as a HENSCHEL® mixer. The content of the toner is preferably from 1 to 10 parts by weight based on 100 parts by weight of the carrier.

There is provided a method for forming fixed images, comprising the step of applying the toner of the present invention to a non-contact fixing apparatus. Also, there is provided a method for forming fixed images, comprising the step of applying the toner of the present invention to a high-speed apparatus with a linear speed of 400 mm/sec or more.

EXAMPLES

The following examples further describe and demonstrate embodiments of the present invention. The examples are given solely for the purposes of illustration and are not to be construed as limitations of the present invention.

[Softening Point]

The softening point refers to a temperature at which a half of the resin flows out, when measured by using the flow tester, "CAPILLARY RHEOMETER CFT-500D" (commercially available from Shimadzu Corporation) (sample: 1 g, rate of raising temperature: 6° C./min, load: 1.96 MPa, and nozzle: $\phi$1 mm×1 mm).

[Acid Value]

The acid value is measured by a method according to JIS K 0070.

[Glass Transition Point]

The glass transition point is determined using a differential scanning calorimeter "DSC 210" (commercially available from Seiko Instruments, Inc.) with raising the temperature at a rate of 10° C./min.

[Storage Modulus]

The storage modulus is measured using a viscoelastometer (rheometer)

Model: RDA-III (commercially available from Rheometrics).

Measurement Jig: A parallel plate having a diameter of 7.9 mm is used for the measurements at lower temperatures of 60° and 70° C., and a parallel plate having a diameter of 25 mm is used for the measurement at a higher temperature of 100° C.

Measurement Sample: The sample used is prepared by pressing a toner to mold into a columnar sample having a diameter of about 8 mm and a height of 2 to 5 mm, and a disc-shaped sample having a diameter of about 25 mm and a thickness of 2 to 3 mm.

The conditions for the measurement device are as follows.

(1) Geometry: Parallel Plate (25 mm)

Radius: 12.5 (mm)

Gap: Gap at 80° C.

A sample is once tightly adhered to the plate at 120° C., and then cooled to 80° C. When "Axal Force" is 0, the Gap is inputted.

1. Dynamic Mechanical Analysis

Frequency/Temperature Sweep

2. Test Parameters

Strain: 0.1 (%)

Initial Temperature: 80 (° C.)

3. Sweep Parameters

Sweep Type: Discrete

Final Temperature: 120 (° C.)

Step Size: 1 (° C.)

Soak Time: 30 (s)

First Frequency: 1.0 (rad/s)

Second Frequency: 6.28 (rad/s)

Third Frequency: 100 (rad/s)

Fourth Frequency: 250 (rad/s)

Fifth Frequency: 500 (rad/s)

4. Options

Delay Before Test: 30 (s)

Correlation Delay: 0.0 (Cycles)

1 Cycle Correlation: No

Auto Tension: yes (2) Geometry: Parallel Plate (7.9 mm)

Radius: 3.95 (mm)

Gap: Gap at 50° C.

A sample is once tightly adhered to the plate at 120° C., and then cooled to 50° C. When "Axal Force" is 0, the Gap is inputted.

1. Dynamic Mechanical Analysis
   Frequency/Temperature Sweep
2. Test Parameters
   Strain: 0.1 (%)
   Initial Temperature: 50 (° C.)
3. Sweep Parameters
   Sweep Type: Discrete
   Final Temperature: 120 (° C.)
   Step Size: 1 (° C.)
   Soak Time: 30 (s)
   First Frequency: 1.0 (rad/s)
   Second Frequency: 6.28 (rad/s)
   Third Frequency: 100 (rad/s)
   Fourth Frequency: 250 (rad/s)
   Fifth Frequency: 500 (rad/s)
4. Options
   Delay Before Test: 30 (s)
   Correlation Delay: 0.0 (Cycles)
   1 Cycle Correlation: No
   Auto Tension: yes

[BET Specific Surface Area]

The BET specific surface area is determined by the nitrogen adsorption method.

[Content of Substance Having Number-Average Molecular Weight of 500 or Less]

The molecular weight distribution is determined by gel permeation chromatography (GPC).

Ten milliliters of tetrahydrofuran is added to 30 mg of a toner, and the ingredients are mixed for 1 hour in a ball-mill. Thereafter, the mixture is filtered with a fluororesin filter having a pore size of 2 μm, "FP-200" (commercially available from Sumitomo Electric Industries, Ltd.), to remove insoluble components to give a sample solution.

Tetrahydrofuran is allowed to flow through a column as an eluate for the determination of molecular weight distribution at a flow rate of 1 ml per minute. The column is stabilized in a thermostat at 40° C., and 100 μl of the sample solution is poured into the column. The content (%) of substances having a molecular weight of 500 or less is calculated as % by area of the corresponding area in the chart obtained from an RI (refractive index) detector. Here, as the analyzed column, there is used "GMHLX+G3000HXL" (commercially available from Tosoh Corporation). A calibration curve is obtained using several types of monodispersed polystyrenes as standard samples.

Resin Preparation Example 1

The amount 1050 g of polyoxypropylene(2.2)-2,2-bis(4-hydroxyphenyl)propane, 355 g of fumaric acid, 1 g of hydroquinone (polymerization inhibitor) and 1.4 g of dibutyltin oxide (esterification catalyst) were reacted at 210° C. for 5 hours at an atmospheric pressure under a nitrogen gas atmosphere. Thereafter, the ingredients were further reacted at 210° C. under reduced pressure, to give a resin A. The resulting resin had a softening point of 102.0° C., an acid value of 19.8 mg KOH/g, and a glass transition point of 58.0° C.

Resin Preparation Example 2

The amount 830 g of polyoxypropylene(2.2)-2,2-bis(4-hydroxyphenyl)propane, 320 g of polyoxyethylene(2.0)-2,2-bis(4-hydroxyphenyl)propane, 233 g of terephthalic acid, 245 g of dodecenylsuccinic anhydride, 140 g of trimellitic anhydride and 4 g of dibutyltin oxide (esterification catalyst) were reacted at 230° C. for 8 hours at an atmospheric pressure under a nitrogen gas atmosphere. Thereafter, the ingredients were further reacted under reduced pressure, to give a resin B. The resulting resin had a softening point of 138.5° C., an acid value of 25.8 mg KOH/g, and a glass transition point of 65.8° C.

Resin Preparation Example 3

The amount 830 g of polyoxypropylene(2.2)-2,2-bis(4-hydroxyphenyl)propane, 320 g of polyoxyethylene(2.0)-2,2-bis(4-hydroxyphenyl)propane, 350 g of terephthalic acid, 45 g of dodecenylsuccinic anhydride, 140 g of trimellitic anhydride and 4 g of dibutyltin oxide (esterification catalyst) were reacted at 230° C. for 8 hours at an atmospheric pressure under a nitrogen gas atmosphere. Thereafter, the ingredients were further reacted under reduced pressure, to give a resin C. The resulting resin had a softening point of 151.3° C., an acid value of 22.4 mg KOH/g, and a glass transition point of 71.7° C.

Resin Preparation Example 4

The amount 1040 g of polyoxypropylene(2.2)-2,2-bis(4-hydroxyphenyl)propane, 10 g of polyoxyethylene(2.0)-2,2-bis(4-hydroxyphenyl)propane, 199 g of terephthalic acid and 4 g of dibutyltin oxide (esterification catalyst) were reacted at 230° C. for 5 hours at an atmospheric pressure under a nitrogen gas atmosphere. The ingredients were further reacted under reduced pressure. The reaction solution was cooled to 210° C., and 209 g of fumaric acid and 1 g of hydroquinone were added thereto. The ingredients were reacted for 5 hours, and thereafter further reacted under reduced pressure, to give a resin D. The resulting resin had a softening point of 109.5° C., an acid value of 21.3 mg KOH/g, and a glass transition point of 64.4° C.

Resin Preparation Example 5

The amount 210 g of polyoxypropylene(2.2)-2,2-bis(4-hydroxyphenyl)propane, 780 g of polyoxyethylene(2.0)-2,2-bis(4-hydroxyphenyl)propane, 458 g of terephthalic acid and 4 g of dibutyltin oxide (esterification catalyst) were reacted at 230° C. for 5 hours at an atmospheric pressure under a nitrogen gas atmosphere. Thereafter, the ingredients were further reacted under reduced pressure, to give a resin E. The resulting resin had a softening point of 106.5° C., an acid value of 2.3 mg KOH/g, and a glass transition point of 64.0° C.

Resin Preparation Example 6

The amount 315 g of polyoxypropylene(2.2)-2,2-bis(4-hydroxyphenyl)propane, 683 g of polyoxyethylene(2.0)-2,2-bis(4-hydroxyphenyl)propane, 453 g of terephthalic acid and 4 g of dibutyltin oxide (esterification catalyst) were reacted at 230° C. for 5 hours at an atmospheric pressure under a nitrogen gas atmosphere. Thereafter, the ingredients were further reacted under reduced pressure, to give a resin F. The resulting resin had a softening point of 113.4° C., an acid value of 3.1 mg KOH/g, and a glass transition point of 67.0° C.

Resin Preparation Example 7

The amount 210 g of polyoxypropylene(2.2)-2,2-bis(4-hydroxyphenyl)propane, 780 g of polyoxyethylene(2.0)-2, 2-bis(4-hydroxyphenyl)propane, 433 g of terephthalic acid and 4 g of dibutyltin oxide (esterification catalyst) were reacted at 230° C. for 5 hours at an atmospheric pressure under a nitrogen gas atmosphere. Thereafter, the ingredients were further reacted under reduced pressure, to give a resin G. The resulting resin had a softening point of 100.7° C., an acid value of 2.3 mg KOH/g, and a glass transition point of 60.0° C.

Resin Preparation Example 8

The amount 394 g of polyoxypropylene(2.2)-2,2-bis(4-hydroxyphenyl)propane, 123 g of polyoxyethylene(2.0)-2,2-bis(4-hydroxyphenyl)propane, 133 g of terephthalic acid, 46 g of dodecenylsuccinic anhydride, 45 g of trimellitic anhydride and 4 g of dibutyltin oxide (esterification catalyst) were reacted at 230° C. for 8 hours at an atmospheric pressure under a nitrogen gas atmosphere. Thereafter, the ingredients were further reacted under reduced pressure, to give a resin H. The resulting resin had a softening point of 151.1° C., an acid value of 8.5 mg KOH/g, and a glass transition point of 65.8° C.

Resin Preparation Example 9

The amount 105 g of polyoxypropylene(2.2)-2,2-bis(4-hydroxyphenyl)propane, 878 g of polyoxyethylene(2.0)-2,2-bis(4-hydroxyphenyl)propane, 161 g of dodecenylsuccinic anhydride, 261 g of fumaric acid, 29 g of trimellitic anhydride, 1 g of hydroquinone (polymerization inhibitor) and 1.4 g of dibutyltin oxide (esterification catalyst) were reacted at 210° C. for 5 hours at an atmospheric pressure under a nitrogen gas atmosphere. Thereafter, the ingredients were reacted at 210° C. under reduced pressure, to give a resin I. The resulting resin had a softening point of 118.5° C., an acid value of 5.4 mg KOH/g, and a glass transition point of 42.3° C.

Resin Preparation Example 10

The amount 525 g of polyoxypropylene(2.2)-2,2-bis(4-hydroxyphenyl)propane, 488 g of polyoxyethylene(2.0)-2,2-bis(4-hydroxyphenyl)propane, 473 g of terephthalic acid and 4 g of dibutyltin oxide (esterification catalyst) were reacted at 230° C. for 5 hours at an atmospheric pressure under a nitrogen gas atmosphere. Thereafter, the ingredients were further reacted under reduced pressure, to give a resin J. The resulting resin had a softening point of 120.3° C., an acid value of 3.5 mg KOH/g, and a glass transition point of 78.5° C.

Example 1

The amount 60 parts by weight of the resin A and 40 parts by weight of the resin C as resin binders, 11 parts by weight of a carbon black "Mogul L" (commercially available from Cabot Corporation) as a colorant, 1 part by weight of "BONTRON S-34" (commercially available from Orient Chemical Co., Ltd.) as a charge control agent and 1 part by weight of "VISCOL 550P" (commercially available from SANYO CHEMICAL INDUSTRIES, LTD.) as a releasing agent were melt-kneaded at 100° C. with a twin-screw extruder "PCM-45" (commercially available from IKEGAI Corporation) with a feed amount of 40 kg/min, at a rotational speed of 200 r/min, and the kneaded mixture was finely pulverized with a jet mill, and classified with a rotary stream classifier, to give a powder having a volume-average particle size of 8.5 $\mu$m.

To 100 parts by weight of the resulting powder were added 1 part by weight of a hydrophobic silica "AEROSIL R-972" (commercially available from Nippon AEROSIL, BET specific surface area: 130 $m^2/g$) and 0.3 parts by weight of a silica "AEROSIL YP-NX 10" (commercially available from Nippon AEROSIL, BET specific surface area: 10 $m^2/g$). The ingredients were mixed with a HENSCHEL® mixer to adhere the silicas to the powder, to give a negatively chargeable toner.

Five parts by weight of the resulting toner and 95 parts by weight of a carrier (core material: copper-zinc-magnesium-based ferrite, coating resin: dimethylsilicone, average particle size: 60 $\mu$m) were mixed with a V blender, to give a developer.

Example 2

The same procedures were carried out as in Example 1 except that 100 parts by weight of the resin D were used as a resin binder, to give a developer.

Example 3

The same procedures were carried out as in Example 1 except that 100 parts by weight of the resin E were used as a resin binder, to give a developer.

Example 4

The same procedures were carried out as in Example 1 except that 70 parts by weight of the resin F and 30 parts by weight of the resin E were used as resin binders, to give a developer.

Example 5

The same procedures were carried out as in Example 1 except that 70 parts by weight of the resin F and 30 parts by weight of the resin G were used as resin binders, to give a developer.

Example 6

The same procedures were carried out as in Example 1 except that 0.3 parts by weight of a silica "AEROSIL YP-NX 30" (commercially available from Nippon AEROSIL, BET specific surface area: 30 $m^2/g$) were used in place of "AEROSIL YP-NX 10," to give a developer.

Comparative Example 1

The same procedures were carried out as in Example 1 except that 80 parts by weight of the resin A and 20 parts by weight of the resin B were used as resin binders, to give a developer.

Comparative Example 2

The same procedures were carried out as in Example 1 except that 100 parts by weight of the resin H were used as a resin binder, to give a developer.

Comparative Example 3

The same procedures were carried out as in Example 1 except that 70 parts by weight of the resin A and 30 parts by weight of the resin B were used as resin binders, to give a developer.

Comparative Example 4

The same procedures were carried out as in Example 1 except that 100 parts by weight of the resin I were used as a resin binder, to give a developer.

Comparative Example 5

The same procedures were carried out as in Example 1 except that 100 parts by weight of the resin J were used as a resin binder, to give a developer.

Comparative Example 6

The same procedures were carried out as in Example 1 except that 0.3 parts by weight of a silica "AEROSIL NAX-50" (commercially available from Nippon Aerosil, BET specific surface area: 50 $m^2/g$) were used in place of "AEROSIL YP-NX 10," to give a developer.

Test Example 1

A developer was loaded in a modified apparatus of a two-component developer device "SD2075" (commercially available from Sharp Corporation) in which the linear speed of the photoconductor was changed to 600 mm/sec, and the fixing device was modified from the heat roller fixing type to the non-contact radiant fixing type, to give unfixed solid images. The unfixed images were transferred to the modified fixing device set under constant fixing conditions, to obtain fixed images. The fixed images obtained was rubbed with a sand-rubber eraser to which a load of 500 g was applied, the eraser having a bottom area of 15 mm×7.5 mm and being moved backward and forward five times over the fixed images. The optical reflective densities of the fixed images before and after the eraser treatment were measured with a reflective densitometer "RD-915" (commercially available from Macbeth Process Measurements Co.). The fixing ability was evaluated as "○," when the ratio of optical reflective density after the eraser treatment to that before the eraser treatment exceeds 70%, or as "x," when the ratio is 70% or less.

Test Example 2

A developer was loaded in the same apparatus as in Test Example 1, and a 100000-sheet continuous printing was carried out with a printing ratio of 3%. Thereafter, black solid images were printed on test sheets of A4 size (210 mm×297 mm). The image density of the resulting fixed images was measured as an optical reflective density with a reflective densitometer "RD-915" (commercially available from Macbeth Process Measurements Co.). Further, the number of white spots was visually counted, and the evaluation was carried out according to the following evaluation criteria. The results are shown in Table 1. Here, the initial image densities (at printing 1000 sheets) are at a level of "◎" for all of the developers.

[Evaluation Criteria of Image Density]

◎: an optical reflective density being 1.43 or more, which is a level of no problem at all;

○: an optical reflective density being 1.37 or more and less than 1.43, which is a level of no problem for practical use;

○-Δ: an optical reflective density being 1.31 or more and less than 1.37, which is a level of no problem for practical use, but slightly lighter tint;

Δ: an optical reflective density being 1.25 or more and less than 1.31, which is slightly lighter tint of some problems for practical use; and x: an optical reflective density being less than 1.25, which is lighter tint of serious problems for practical use.

[Evaluation Criteria of White Spots]

○: number of white spots is 5 or less; and x: number of white spots is 6 or more.

The storage modulus of toner, the content of the substance having a number-average molecular weight of 500 or less of each of the toners, and the results of Test Examples 1 and 2 are shown in Table 1.

TABLE 1

| | Storage Modulus (Pa) | | | Content of Substance Having Number-Average Molecular Weight | Fixing | Image | White |
|---|---|---|---|---|---|---|---|
| | 60° C. | 70° C. | 100° C. | of 500 or Less (%) | Ability | Density* | Spots |
| Ex. 1 | $5.1 \times 10^8$ | $2.0 \times 10^7$ | $2.8 \times 10^4$ | 3.2 | ○ | ○ (1.39) | ○ |
| Ex. 2 | $7.5 \times 10^8$ | $8.6 \times 10^7$ | $4.6 \times 10^4$ | 2.8 | ○ | ◎ (1.46) | ○ |
| Ex. 3 | $7.3 \times 10^8$ | $4.0 \times 10^7$ | $3.5 \times 10^4$ | 3.2 | ○ | ○ (1.40) | ○ |
| Ex. 4 | $7.4 \times 10^8$ | $4.2 \times 10^7$ | $3.8 \times 10^4$ | 3.5 | ○ | ○ (1.40) | ○ |
| Ex. 5 | $7.1 \times 10^8$ | $4.0 \times 10^7$ | $2.6 \times 10^4$ | 4.2 | ○ | ○-Δ (1.35) | ○ |
| Ex. 6 | $5.1 \times 10^8$ | $2.0 \times 10^7$ | $4.6 \times 10^4$ | 3.2 | ○ | ○-Δ (1.35) | ○ |
| Comp. Ex. 1 | $1.7 \times 10^8$ | $2.7 \times 10^6$ | $8.3 \times 10^3$ | 3.0 | ○ | X (1.12) | ○ |
| Comp. Ex. 2 | $7.6 \times 10^8$ | $5.8 \times 10^7$ | $8.1 \times 10^4$ | 3.4 | X | ○ (1.39) | X |
| Comp. Ex. 3 | $5.0 \times 10^8$ | $5.5 \times 10^6$ | $2.7 \times 10^4$ | 3.4 | ○ | X (1.22) | ○ |
| Comp. Ex. 4 | $1.1 \times 10^8$ | $8.1 \times 10^7$ | $3.1 \times 10^4$ | 3.7 | ○ | X (1.18) | ○ |
| Comp. Ex. 5 | $9.8 \times 10^8$ | $4.6 \times 10^8$ | $5.2 \times 10^4$ | 3.1 | ○ | Δ (1.28) | ○ |
| Comp. Ex. 6 | $5.1 \times 10^8$ | $2.1 \times 10^8$ | $4.6 \times 10^4$ | 3.2 | ○ | X (1.21) | ○ |

Note

*Inside of each parenthesis shows optical reflective density.

It is seen from the above results that the toners of Examples which are excellent in the fixing ability and provide high-quality fixed images with high image density and without white spots can be obtained. In contrast, in the toners of Comparative Examples 1, and 3 to 5, which have storage moduli at 60° C. and 70° C. outside the desired ranges, the image density is insufficient. In the toner of Comparative Example 2, which has too high a storage modulus at 100° C., the fixing ability is insufficient, and white spots are generated in the fixed images. In addition, in the toner of Comparative Example 6 in which the fine inorganic particles having a large BET specific surface area, namely the fine inorganic particles having a relatively small particle size, are used, there is observed a lowering in the image density, which is presumably caused by embedment of the fine inorganic particles during the durability printing test.

According to the present invention, there can be provided a toner which has excellent durability and continuously gives high-quality fixed images even in a non-contact fixing method, and a two-component developer comprising the toner.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner comprising: a resin binder, a colorant, and fine inorganic particles having a BET specific surface area of 30 $m^2/g$ or less, wherein the fine inorganic particles are added as an external additive, wherein the toner has a storage modulus at 100° C. using a 25 mm parallel plate of $7\times10^4$ Pa or less, a storage modulus at 60° C. ($G'_{60}$) using a 7.9 mm parallel plate of from $3\times10^8$ to $1\times10^9$ Pa, and a storage modulus at 70° C. ($G'_{70}$) using a 7.9 mm parallel plate of from $7\times10^6$ to $3\times10^8$ Pa and a $G'_{60}/G'_{70}$ ratio of 2 or more and less than 30.

2. The toner according to claim 1, wherein the resin binder comprises from 50 to 100% by weight of a polyester.

3. The toner according to claim 1, wherein the fine inorganic particles having a BET specific surface area of 30 $m^2/g$ or less are silica.

4. The toner according to claim 1, wherein a silica having a BET specific surface area of 50 $m^2/g$ or more is used together with the fine inorganic particles having a BET specific surface area of 30 $m^2/g$ or less.

5. A two-component developer comprising the toner as defined in claim 1 and a carrier.

6. A method for forming fixed images, comprising the step of fixing a toner image carried on a sheet to the sheet with, to a non-contact fixing apparatus wherein the fixing is carried out by applying light or heat energy to the toner image on the sheet in a non-contacting state, wherein the toner image is formed by a toner comprising a resin binder, a colorant, and fine inorganic particles having a BET specific surface area of 30 $m^2/g$ or less, wherein the fine inorganic particles are added as an external additive, wherein the toner has a storage modulus at 100° C. using a 25 mm parallel plate of $7\times10^4$ Pa or less, a storage modulus at 60° C. ($G'_{60}$) using a 7.9 mm parallel plate of from $3\times10^8$ to $1\times10^9$ Pa, a storage modulus at 70° C. ($G'_{70}$) using a 7.9mm parallel plate of from $7\times10^6$ to $3\times10^8$ Pa, and a $G'_{60}/G'_{70}$ ratio of 2 or more and less than 30.

7. A method according to claim 6 wherein the non-contact fixing apparatus is a high-speed apparatus with a linear speed of 400 mm/sec or more.

8. A toner comprising:

a resin binder, a colorant, and fine inorganic particles having a BET specific surface area of 30 $m^2/g$ or less, wherein the fine inorganic particles are added as an external additive, wherein the toner has a storage modulus at 100° C. using a 25 mm parallel plate of $7\times10^4$ Pa or less, a storage modulus at 60° C. using a 7.9 mm parallel plate of from $3\times10^8$ Pa to $1\times10^9$ Pa, and a storage modulus at 70° C. using a 7.9 mm parallel plate of from $7\times10^6$ to $3\times10^8$ Pa, wherein a substance originated from the resin binder component having a molecular weight of 500 or less is contained in the toner in an amount of from 1 to 4% by area as the corresponding area in the chart of a gel-permeation chromatogram obtained from a RI (refractive index) detector.

9. The toner according to claim 8, wherein the resin binder comprises from 50 to 100% by weight of a polyester.

10. The toner according to claim 8, wherein the fine inorganic particles having a BET specific surface area of 30 $m^2/g$ or less are silica.

11. The toner according to claim 8, wherein a silica having a BET specific surface area of 50 $m^2/g$ or more is used together with the fine inorganic particles having a BET specific surface area of 30 $m^2/g$ or less.

12. A two-component developer comprising the toner as defined in claim 8 and a carrier.

13. A method for forming fixed images, comprising the step of fixing a toner image carried on a sheet to the sheet with a non-contact fixing apparatus wherein the fixing is carried out by applying light or heat energy to the toner image on the sheet in a non-contacting state, wherein the toner image is formed by a toner comprising a resin binder, a colorant, and fine inorganic particles having a BET specific surface area of 30 $m^2/g$ or less, wherein the fine inorganic particles are added as an external additive, wherein the toner has a storage modulus at 100° C. using a 25 mm parallel plate of $7\times10^4$ Pa or less, a storage modulus at 60° C. using a 7.9 mm parallel plate of from $3\times10^8$ Pa to $1\times10^9$ Pa, and a storage modulus at 70° C. using a 7.9 mm parallel plate of from $7\times10^6$ to $3\times10^8$ Pa, wherein a substance originated from the resin binder component having a molecular weight of 500 or less is contained in the toner in an amount of from 1 to 4% by area as the corresponding area in the chart of a gel-permeation chromato gram obtained from a RI (refractive index) detector.

14. A method according to claim 13 wherein the non-contact fixing apparatus is a high-speed apparatus with a linear speed of 400 mm/sec or more.

* * * * *